US011813496B2

(12) United States Patent
Villarreal, III

(10) Patent No.: US 11,813,496 B2
(45) Date of Patent: Nov. 14, 2023

(54) LOWER LEG AND ANKLE REHABILITATION AND EXERCISER

(71) Applicant: Santos Villarreal, III, McAllen, TX (US)

(72) Inventor: Santos Villarreal, III, McAllen, TX (US)

( * ) Notice: Subject to any disclaimer, the term of this patent is extended or adjusted under 35 U.S.C. 154(b) by 0 days.

(21) Appl. No.: 17/446,157

(22) Filed: Aug. 26, 2021

(65) Prior Publication Data

US 2023/0072184 A1 Mar. 9, 2023

(51) Int. Cl.

*A63B 21/00* (2006.01)
*A63B 21/055* (2006.01)
*A63B 21/04* (2006.01)

(52) U.S. Cl.

CPC ..... *A63B 21/4013* (2015.10); *A63B 21/0407* (2013.01); *A63B 21/0552* (2013.01); *A63B 21/0555* (2013.01); *A63B 21/0557* (2013.01); *A63B 21/4025* (2015.10); *A63B 21/4034* (2015.10); *A63B 21/4015* (2015.10)

(58) Field of Classification Search

CPC ..... A63B 21/00061; A63B 21/0442; A63B 21/0552; A63B 21/0555; A63B 21/0557; A63B 21/4013; A63B 21/4015; A63B 21/4025; A63B 21/4034; A63B 21/00047; A63B 21/00178; A63B 21/0407; A63B 2023/006

See application file for complete search history.

(56) References Cited

U.S. PATENT DOCUMENTS

| | | | | |
|---|---|---|---|---|
| 5,215,508 | A | 6/1993 | Bastow | |
| 5,645,516 | A | 7/1997 | Foster | |
| 5,891,002 | A | 4/1999 | Maki | |
| 6,110,078 | A | 8/2000 | Dyer | |
| 6,283,897 | B1 | 9/2001 | Patton | |
| 7,322,914 | B1 * | 1/2008 | Vittone | A63B 23/025 482/146 |
| 7,666,126 | B2 * | 2/2010 | Rempe | A63B 26/003 482/121 |
| 9,744,397 | B2 * | 8/2017 | Pagano | A63B 21/0557 |
| 10,183,194 | B1 * | 1/2019 | Louis | A63B 21/023 |
| 10,434,365 | B2 | 10/2019 | Mack | |
| 11,052,275 | B1 | 7/2021 | Garick | |
| 2002/0193210 | A1 | 12/2002 | Turner | |
| 2012/0138113 | A1 * | 6/2012 | Spinabella | A47B 97/00 108/50.14 |

* cited by examiner

*Primary Examiner* — Megan Anderson

(57) ABSTRACT

An article of manufacture for providing a lower leg and Achilles tendon exercise device according to the present invention, the exercise device includes a top frame structure having a first plurality of connection hooks about its perimeter, a bottom frame structure oriented in parallel to the top frame structure having a second plurality of hooks about its perimeter, a plurality of vertical support members coupled between the top frame structure and the bottom frame structure, a shoe support member having a plurality of connection hooks positioned about an outer edge, and a plurality of stretchable cords configured to couple the shoe support member to the top frame structure and the bottom frame structure, the stretchable cords coupled to the top frame structure position the shoe support member above the bottom support structure.

15 Claims, 17 Drawing Sheets

LOWER LEG AND ANKLE REHABILITATION AND EXERCISER

TECHNICAL FIELD

This application relates in general to an article of manufacture for providing a rehabilitation and exercise device, and more specifically, to an article of manufacture providing a lower leg and ankle exercise device.

BACKGROUND

The main function of the Achilles tendon is the transmission of power from the calf muscles to the heel and the foot. This makes it possible to flex the foot; crucial movement when walking and running. Stretching the tendon can help people recover from Achilles tendon damage by increasing mobility.

Therefore, a need exists for an article of manufacture for providing a lower leg and ankle exercise device. The present invention attempts to address the limitations and deficiencies in prior solutions according to the principles and example embodiments disclosed herein.

SUMMARY

In accordance with the present invention, the above and other problems are solved by providing an article of manufacture for a lower leg and ankle exercise device according to the principles and example embodiments disclosed herein.

In one embodiment, the present invention is an article of manufacture for providing a lower leg and ankle exercise device. The exercise device includes a top frame structure having a first plurality of connection hooks about its perimeter, a bottom frame structure oriented in parallel to the top frame structure having a second plurality of hooks about its perimeter, a plurality of vertical support members coupled between the top frame structure and the bottom frame structure, a shoe support member having a plurality of connection hooks positioned about an outer edge, and a plurality of stretchable cords configured to couple the shoe support member to the top frame structure and the bottom frame structure, the stretchable cords coupled to the top frame structure position the shoe support member above the bottom support structure.

In another aspect of the present invention, the connection hooks having a keyhole end and an inner end.

In another aspect of the present invention, the top frame structure and the bottom frame structure comprise an identical set of straight members arranged in a hexagon shape, the hexagon shape having an open end and a closed end.

In another aspect of the present invention, each of the straight members having at least one connection hook.

In another aspect of the present invention, the set of straight support members having a rectangular shape with a hollow center.

In another aspect of the present invention, the top frame structure and the bottom frame structure having a U-shaped frame members, the connection hooks being located about an outer edge of the U-shaped frame members.

In another aspect of the present invention, the connection hooks on the two sides of the U-shaped frame members are located in identical positioned from the open end.

In another aspect of the present invention, the shoe support member having connection hooks positioned on opposing sides to each other.

In another aspect of the present invention, each of the stretchable cords comprising a stretchable band having opposing ends and an elastic band connection end coupled to each opposing end, the elastic band connection end being configured to engage a surface of the top and bottom frame structures with a first end and to engage a surface of the shoe support member when the stretchable band is within the connection hooks.

In another aspect of the present invention, the stretchable bands having a resistance corresponding to a color marking of the stretchable bands between 1.1 lbs. and 7.9 lbs. when stretched an elongation of 25% of its length.

In another aspect of the present invention, the stretchable bands having a resistance corresponding to a color marking of the stretchable bands between 2.9 lbs. and 21.6 lbs. when stretched an elongation of 100% of its length.

In another aspect of the present invention, the stretchable bands having a resistance corresponding to a color marking of the stretchable bands between 5.9 lbs. and 40.1 lbs. when stretched an elongation of 250% of its length.

In another aspect of the present invention, the colored markings comprise one or more of the following: a yellow, a red, a green, a blue, a black, a silver, and a gold marking.

In another aspect of the present invention, the top frame structure and the bottom frame structure are made of steel In another aspect of the present invention, the set of straight members are welded together.

The foregoing has outlined rather broadly the features and technical advantages of the present invention in order that the detailed description of the invention that follows may be better understood. Additional features and advantages of the invention will be described hereinafter that form the subject of the claims of the invention.

It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Referring now to the drawings in which like reference numbers represent corresponding parts throughout.

DETAILED DESCRIPTION

Figure 1A:
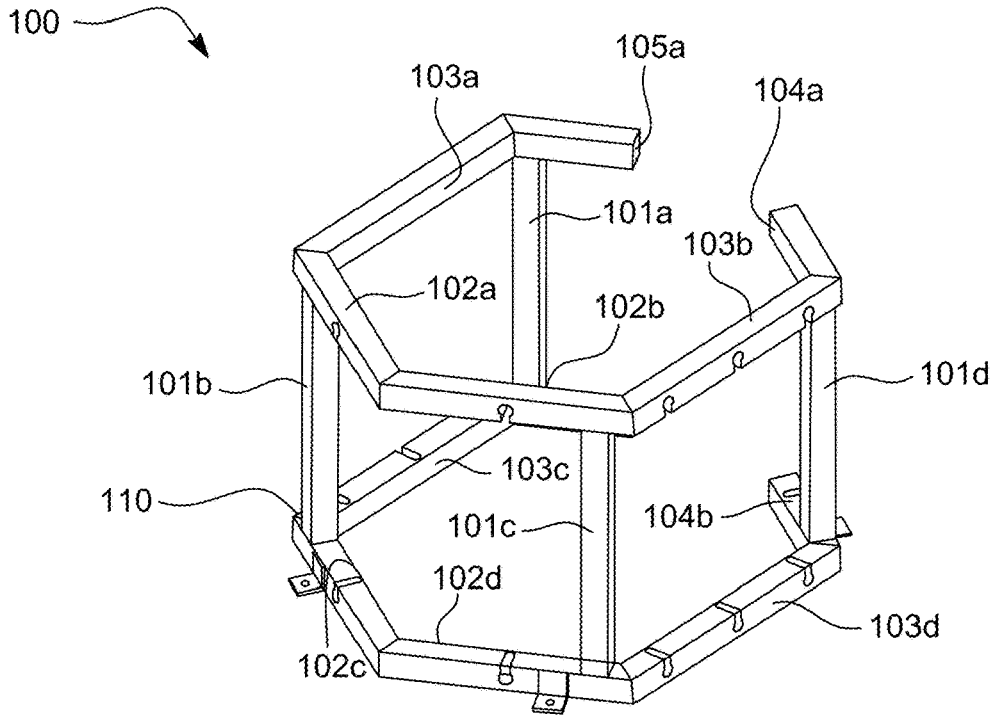
FIGS. 1*a-b* illustrate example embodiments of an article of manufacture for providing a lower leg and ankle exercise device.

This application relates in general to an article of manufacture for providing a rehabilitation and exercise device, and more specifically, to an article of manufacture providing a lower leg and ankle exercise device according to the present invention.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In describing embodiments of the present invention, the following terminology will be used. The singular forms "a," "an," and "the" include plural referents unless the context clearly dictates otherwise. As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As used herein, the singular forms "a," "an," and "the" are intended to include the plural forms as well, unless the context clearly indicates otherwise.

It further will be understood that the terms "comprises," "comprising," "includes," and "including" specify the presence of stated features, steps or components, but do not preclude the presence or addition of one or more other features, steps or components. It also should be noted that in some alternative implementations, the functions and acts noted may occur out of the order noted in the figures. For example, two figures shown in succession may in fact be executed substantially concurrently or may sometimes be executed in the reverse order, depending upon the functionality and acts involved.

The terms "individual" and "user" refer to an entity, e.g., a human, using an article of manufacture providing a lower leg and ankle exercise device according to the present invention. The term user herein refers to one or more users.

The term "invention" or "present invention" refers to the invention being applied for via the patent application with the title "Lower Leg and Ankle Exerciser." Invention may be used interchangeably with exercise device.

Figure 1B:
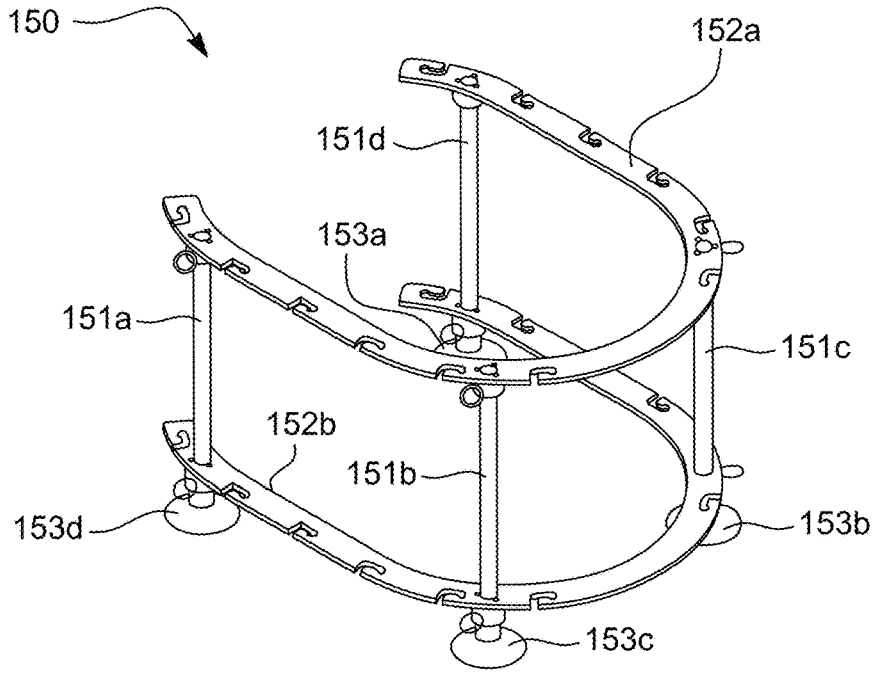

In general, the present disclosure relates to an article of manufacture providing a lower leg and Achilles tendon exercise device according to the present invention. FIGS. 1*a-b* illustrate example embodiments of an article of manufacture providing a lower leg and ankle exercise device. FIG. 1*a* shows a first embodiment of a two-level, multi-segment frame structure 100 connected by four vertical support members 101*a-d*. Each level of the frame structure 110 is made up of six segments 101-105 in the shape of a hexagon having part of two end segments 104*a-b*, 105*a-b* shortened to create an opening into the center of the frame structure 110. The top level is essentially the same as the bottom level. The only difference between the two levels is the location of connection hooks found about the frame structure 110 located on the inner surfaces of the segments.

Figure 2A:
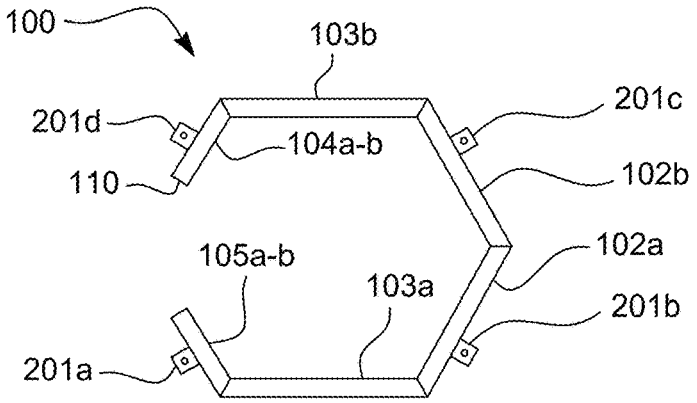
FIGS. 2*a-b* illustrate top and side views of a first embodiment of an article of manufacture providing a lower leg and ankle exercise device according to the present invention.

Each hexagon frame element is made up of two long 3-connection hook segments 103*a-b*, 103*c-d*, along a long side of the hexagon, two long I-connection hook segments 102*a-b*, 102*c-d* forming the closed end of the hexagon, and two short I-connection hook segments 104*a-b*, 105*a-b* creating the opening into the center of the hexagon. Each connection hook in the segments comprises a keyhole-shaped slot cut though an outer edge of the hexagon connection hook segments with a straight line slot cut through a top edge of the hexagon connection hook segments. The keyhole-shaped slot and straight line slot are aligned to connect to a corresponding keyhole-shaped slot and matching straight line slot. Four L-shaped tabs 201*a-d*, as shown in FIG. 2*a*, are coupled to the outer edge of the hexagon connection hook segments of the lower hexagon frame.

The lower leg and ankle exercise device 100 is machine constructed to exercise the lower leg and ankle muscles. The lower leg and ankle exercise device 100 may be used for rehabilitation and strength, exercise, and flexibility training. The areas that are targeted with the lower leg and ankle exercise device 100 are the tibialis anterior muscle, peroneus longus muscle, and the gastrocnemius muscle and allows for reduced stress on tendons in the ankle, calf, and lower knee.

The lower leg and ankle exercise device 100 helps athletes and average active persons develop the healthy habit of exercising the lower leg muscles for the benefits it provides such as: healthier knees, injury prevention for knees and ankles, rehabilitation, and exercise.

Elastic bands, shown in FIGS. 15*a-d*, may be mounted in multiple positions of the connection hooks that, when coupled to a shoe plate shown in FIG. 14, secures the user's foot. With this arrangement, the bands provide resistance to allow the user to perform any ankle movements to work the muscle group to be targeted. The elastic bands support the shoe placed above the ground and may provide different levels of resistance appropriate for individual users.

FIG. 1*b* shows a second embodiment of a two-level, multi-segment frame structure 150 connected by four vertical support members 151*a-d*. The frame structure 150 comprises a pair of horseshoe-shaped plates 152*a-b* separated by the four vertical support members 151*a-d*. Each of the four vertical support members 151*a-d* is coupled to a corresponding set of support feet 153*a-d* in which the lower horseshoe-shaped plates 152*b* are coupled there to position the lower horseshoe-shaped plates 152*b* about the ground.

A set of connection hooks 154*a-n* is cut through the horseshoe-shaped level support members plates 152*a-b* having attachment slots along an outer edge of the horseshoe-shaped level support members plates 152*a-b*. The connection hooks 154*a-n* couple the frame structure 151 to the shoe plate as described in FIG. 14 by using the elastic bands in the same manner disclosed above. The frame structure 150 may be used for exercise training in a similar manner as the frame structure of FIG. 1*a*.

Figure 2B:
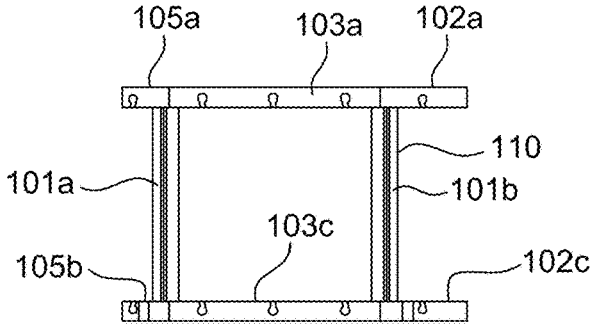

FIGS. 2*a-b* illustrate top and side views of a first embodiment of an article of manufacture providing a lower leg and ankle exercise device according to the present invention. FIG. 2*a* shows a top view of the frame structure 110 having the various connection hook support members arranged to create the hexagon as disclosed above with respect to FIG. 1*a*. The set of four L-shaped tabs 201*a-d* is arranged along the outer edge of the frame structure 100 whereby the tabs 201*a-d* are arranged to place through holes in each of four L-shaped tabs 201*a-d* and arranged vertically to permit the entire frame structure 100 to be coupled to a floor, ground, or supporting surface.

FIG. 2*b* shows a side view of the frame structure in which the vertical support members 101*a-d* are coupled between the two hexagon frame elements 202*a-b*. The side view of FIG. 2*b* shows one side of the frame structure having the long 3-connection hook segments 103*a-b* oriented in the center of the side view. The keyhole-shaped slot of the various connection hooks is visible in the hexagon connection hook segments. The hexagon connection hook segments are typically made of metal and may be welded to each other to construct the pair of hexagon frame elements 202*a-b* as well as couple the vertical support members 101*a-d* to the two hexagon frame elements 202*a-b*.

Figure 3A:
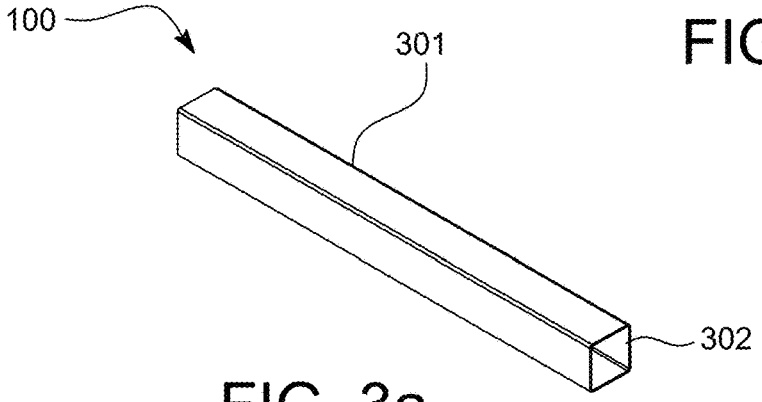
FIGS. 3*a-c* illustrate multiple views of a vertical support member of the first embodiment of an article of manufacture providing a lower leg and ankle exercise device according to the present invention.
Figure 3B:
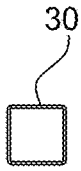
Figure 3C:
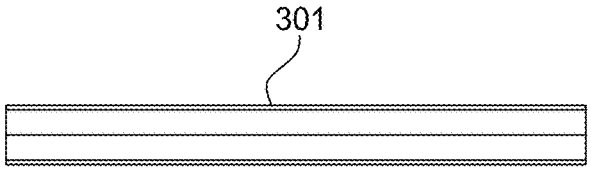

FIGS. 3*a-c* illustrate multiple views of a vertical support member of the first embodiment of an article of manufacture providing a lower leg and ankle exercise device according to the present invention. FIG. 3*a* shows a diagonal perspective view of one of the vertical support members 101. The vertical support member IOI is made of a hollow metal rod 301 having a defined length corresponding to the height between the pair of hexagon frame elements 202*a-b* of the frame structure 110. FIG. 2*b* shows an end view of the hollow support member 301 and FIG. 2*c* shows a side view of the hollow support member 301. In this embodiment, the hollow support member 301 is shown to be square in shape. One skilled in the art will recognize that other shapes, including round, oval, and rectangular, may be used to define the hollow support member 301. Additionally, the hexagon frame elements 202*a-b* may be configured with different numbers of connection hook segments having different lengths to construct other shaped frame elements such as a square, rectangle, and an octagon as possible arrangements.

Figure 4A:
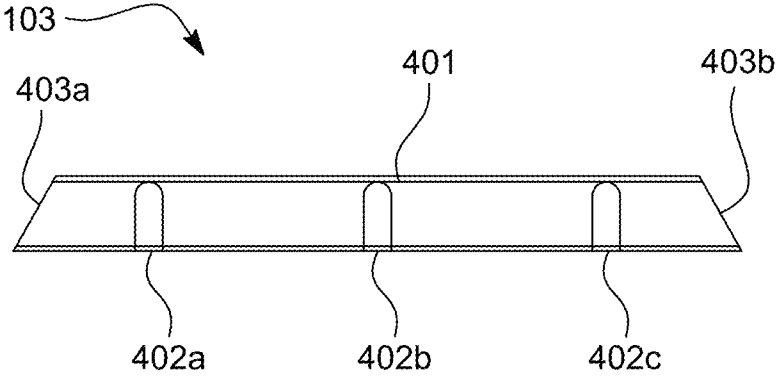
FIGS. 4*a-d* illustrate multiple views of a 3-hook long side member of the first embodiment of an article of manufacture providing a lower leg and ankle exercise device according to the present invention.
Figure 4B:
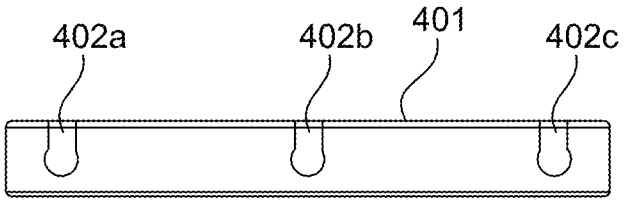
Figure 4C:
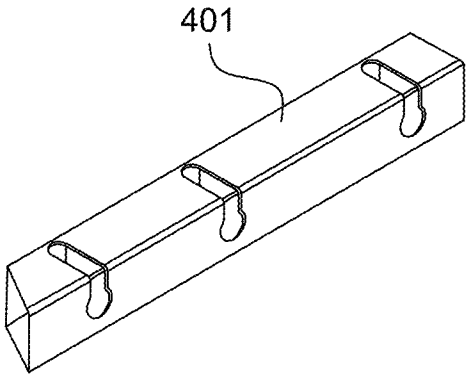
Figure 4D:
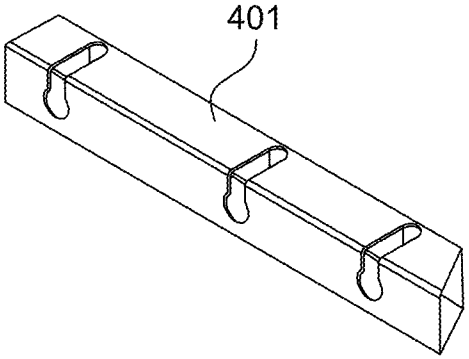

FIGS. 4*a-d* illustrate multiple views of a 3-hook long side member of the first embodiment of an article of manufacture providing a lower leg and ankle exercise device according to the present invention. FIG. 4*a* shows a top view of the 3-hook long segments 103*a-b*, 103*c-d* having a hollow side support member 401 with three straight slots of the connection hooks 402*a-c* being visible and having diagonal shaped ends 403. FIG. 4*b* shows a side view of the long 3-hook long segments 103*a-b*, 103*c-d* having the hollow side support member 401 with three keyhole slots of the connection hooks 402*a-c* being visible. FIGS. 4*c-d* show opposite diagonal perspective views of the hollow side support member 401 with the connection hooks 402*a-c* being visible.

The diagonal ends of the hollow side support member 401 are shown to have a 60° angle between the edge of the end and the outer edge of the hollow side support member 401. This angle corresponds to an angle of a hexagon.

Figure 5A:
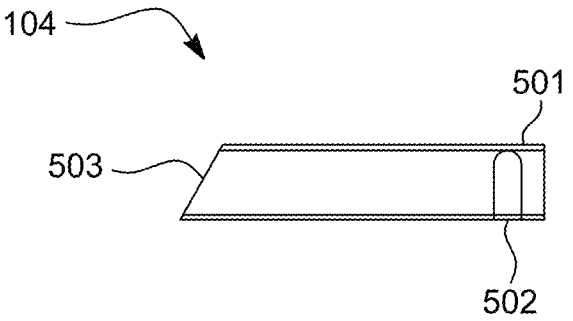
FIGS. 5*a-d* illustrate multiple views of a front I-hook short side member of the first embodiment of an article of manufacture providing a lower leg and ankle exercise device according to the present invention.
Figure 5B:
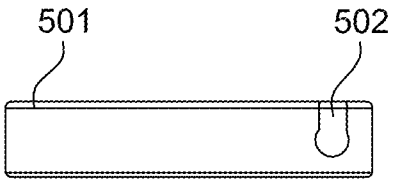
Figure 5C:
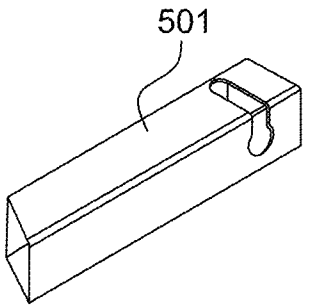
Figure 5D:
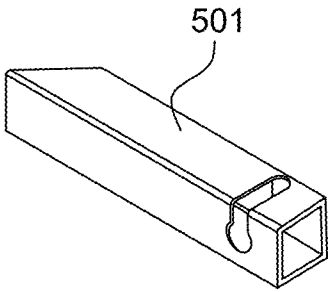

FIGS. 5*a-d* illustrate multiple views of a front I-hook short side member of the first embodiment of an article of manufacture providing a lower leg and ankle exercise device according to the present invention. FIG. Sa shows a top view of the short I-hook segments 104*a-b*, having a first hollow short side support member 501 with a single straight slot of the connection hook 502 being visible and having a single diagonal-shaped end 503 at an end closest to the connection hook 502. FIG. Sb shows a side view of the short I-hook segments 104*a-b* having the first hollow short side support member 501 with the single keyhole slot of the connection hook 502 being visible. FIGS. 5*c-d* show opposite diagonal perspective views of the first hollow short side support member 501 with the connection hook 502 being visible.

The diagonal ends of the hollow short side support member 501 are shown to have a 60° angle between the edge of the end and the outer edge of the first hollow short side support member 501. This angle corresponds to an angle of a hexagon.

Figure 6A:
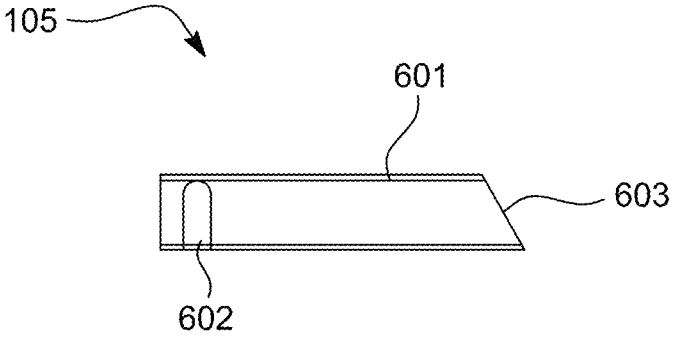
FIGS. 6*a-d* illustrate multiple views of a rear I-hook side member of the first embodiment of an article of manufacture providing a lower leg and ankle exercise device according to the present invention.
Figure 6B:
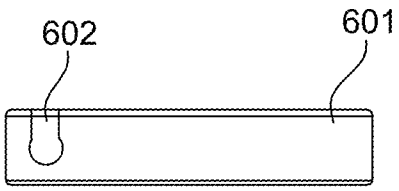
Figure 6C:
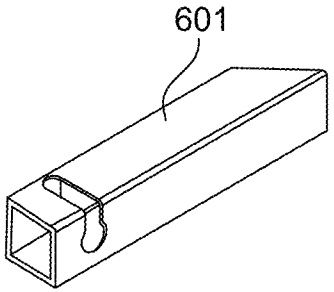
Figure 6D:
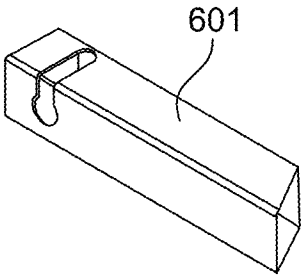
Figure 7B:
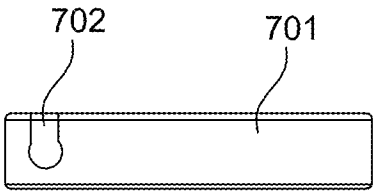
FIGS. 7*a-d* illustrate multiple views of a I-hook long side member of the first embodiment of an article of manufacture providing a lower leg and ankle exercise device according to the present invention.
Figure 7D:
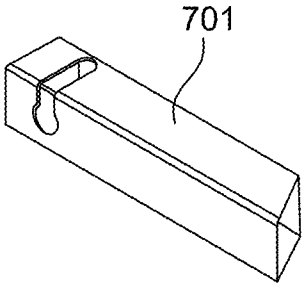
Figure 7A:
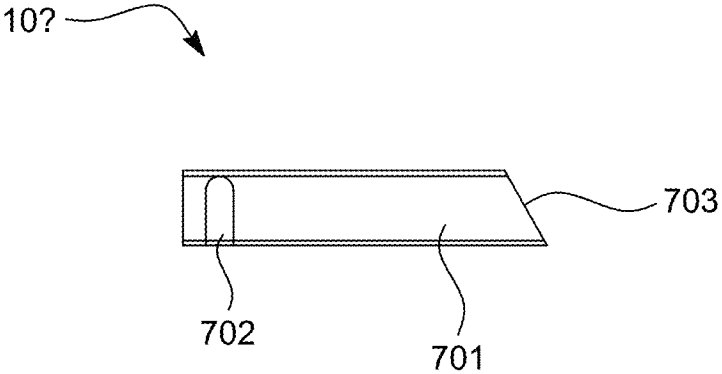
Figure 7C:
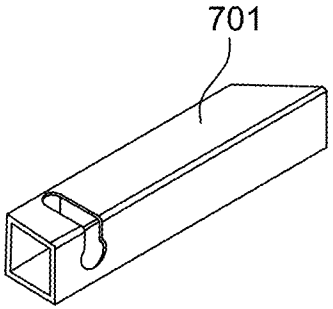
Figure 8A:
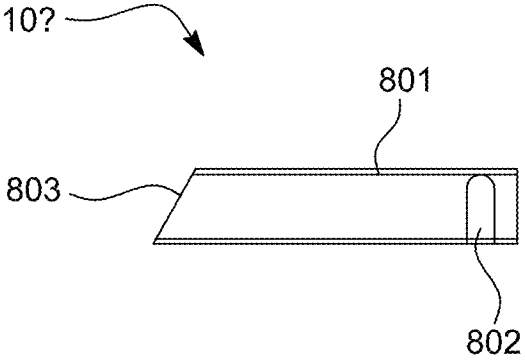
FIGS. 8*a-d* illustrate multiple views of a vertical support member of the first embodiment of an article of manufacture providing a lower leg and ankle exercise device according to the present invention.
Figure 8B:
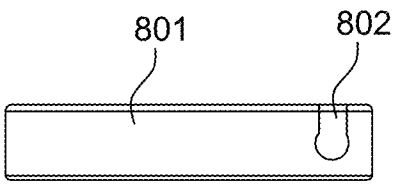
Figure 8C:
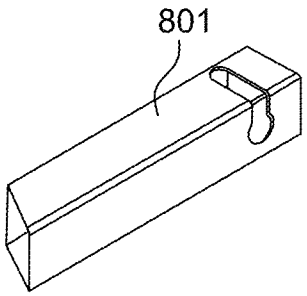
Figure 8D:
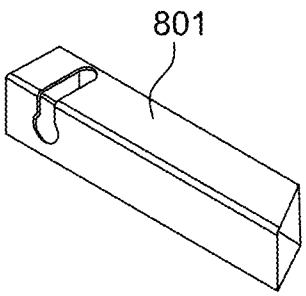

FIGS. 6*a-d* illustrate multiple views of a rear I-hook side member of the first embodiment of an article of manufacture providing a lower leg and ankle exercise device according to the present invention. FIG. 6*a* shows a top view of the short I-hook segments 105*a-b*, having a second hollow short side support member 601 with a single straight slot of the connection hook 602 being visible and having a single diagonal-shaped end 603 at an end closest to the connection hook 602. FIG. 6*b* shows a side view of the short I-hook segments 105*a-b* having the second hollow short side support member 601 with the single keyhole slot of the connection hook 602 being visible. FIGS. 6*c-d* show opposite diagonal perspective views of the second hollow short side support member 601 with the connection hook 602 being visible.

The diagonal ends of the hollow short side support member 601 are shown to have a 60° angle between the edge of the end and the outer edge of the second hollow short side support member 601. This angle corresponds to an angle of a hexagon.

FIGS. 7*a-d* illustrate multiple views of a I-hook long side member of the first embodiment of an article of manufacture providing a lower leg and ankle exercise device according to the present invention. Similarly, FIGS. 8*a-d* illustrate multiple views of a rear 1-hook side member of the first embodiment of an article of manufacture providing a lower leg and ankle exercise device according to the present invention. These segments provide the top and bottom segments of the frame structure 101 at its open end. The connection hooks are located at slightly different positions as the top and bottom parts of the frame structure 101 may utilize slightly different arrangements as desired.

Figure 9A:
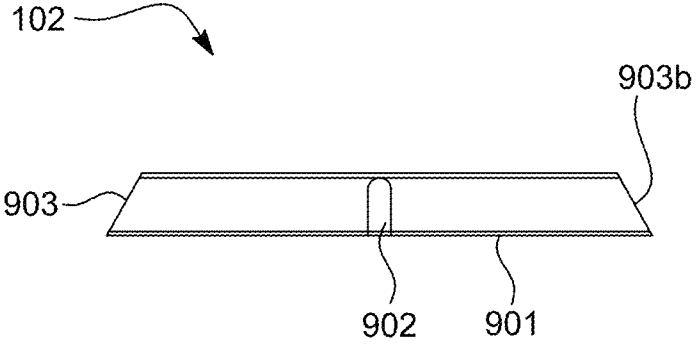
FIGS. 9*a-d* illustrate multiple views of a rear I-hook side member of the first embodiment of an article of manufacture providing a lower leg and ankle exercise device according to the present invention.
Figure 9B:
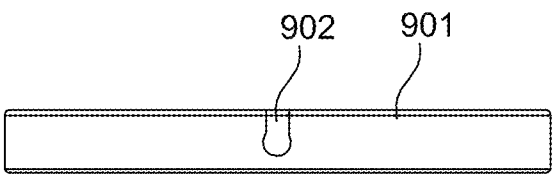
Figure 9C:
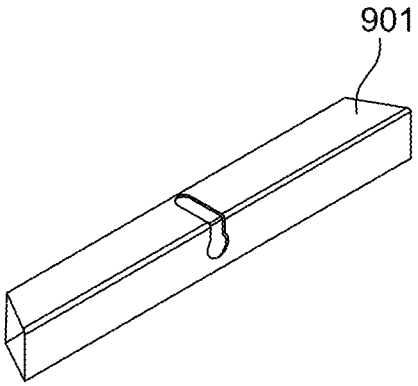
Figure 9D:
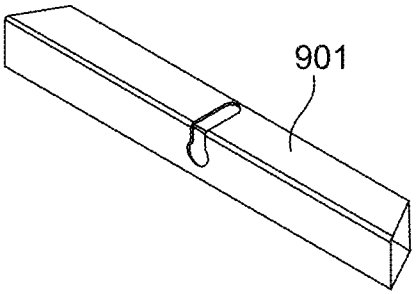

FIGS. 9*a-d* illustrate multiple views of a rear I-hook side member of the first embodiment of an article of manufacture providing a lower leg and ankle exercise device according to the present invention. FIG. 9*a* shows a top view of the long I-hook segments 102*a-b*, having a center hollow short side support member 901 with a single straight slot of the connection hook 902 being visible and having diagonal shaped ends 903*a-b*. FIG. 9*b* shows a side view of the long I-hook segments 102*a-b* having the center hollow long center support member 901 with the single keyhole slot of the connection hook 902 being visible. FIGS. 9*c-d* show opposite diagonal perspective views of the hollow long center support member 901 with the connection hooks 902*a-b* being visible.

The diagonal ends of the hollow long center support member 901 are shown to have a 60° angle between the edge of the end and the outer edge of the hollow long center support member 901. This angle corresponds to an angle of a hexagon.

Figure 10B:
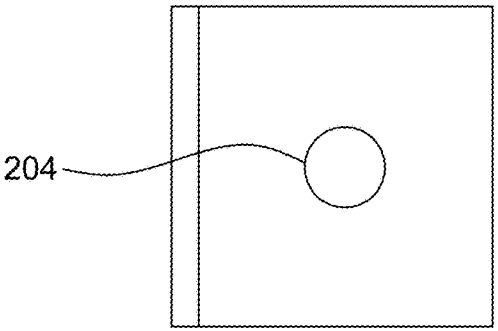
FIGS. 10*a-c* illustrate multiple views of an L-shaped tab of the first embodiment of an article of manufacture providing a lower leg and ankle exercise device according to the present invention.
Figure 10C:
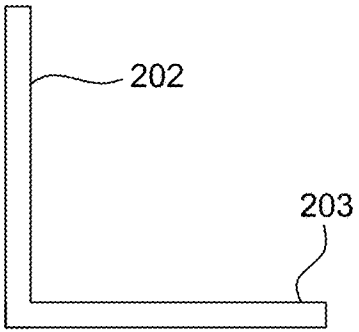
Figure 10A:
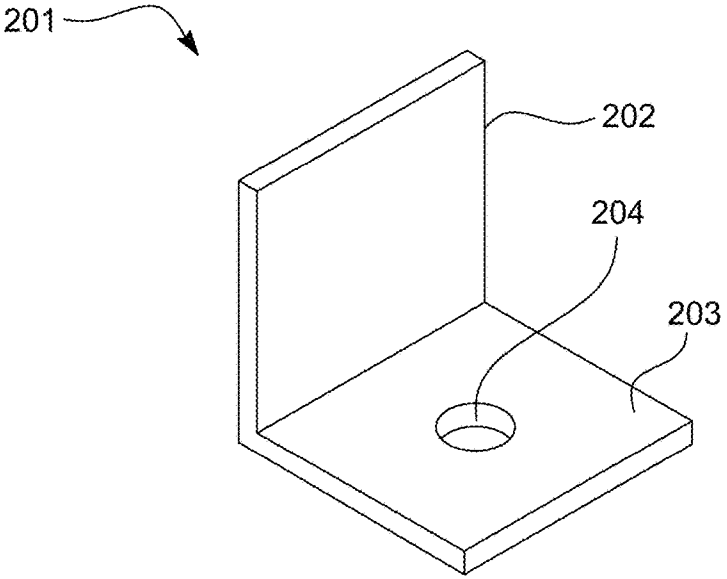

FIGS. 10*a-c* illustrate multiple views of an L-shaped tab 201*a-d* of the first embodiment of an article of manufacture providing a lower leg and ankle exercise device according to the present invention. The L-shaped tab 201 comprises a vertical surface 202 and a horizontal surface 203 joined at a right angle along each side of the two surfaces of the L-shaped tab 201. A through hole 204 is located in the center of the horizontal surface 203. An outer side of the vertical surface 202 of the L-shaped tab 201 is coupled to the outer edge of the lower hexagon connection hook segment 202*b*, positioning the through hole 204 along a floor, ground, or support surface.

Figure 11A:
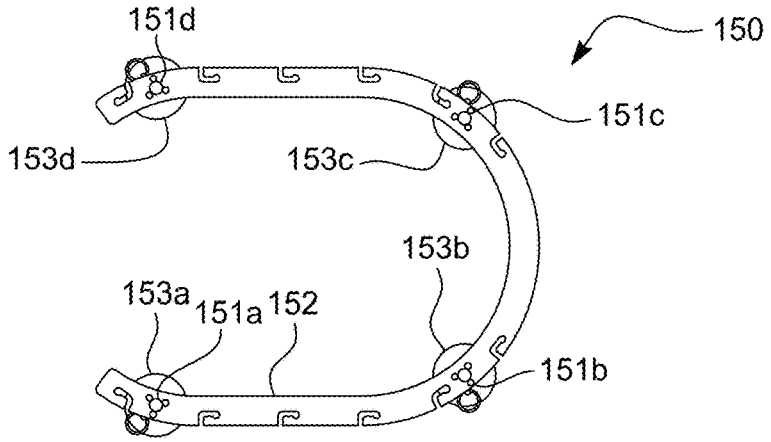
FIGS. 11*a-b* illustrate top and side views of a second embodiment of an article of manufacture providing a lower leg and ankle exercise device according to the present invention.
Figure 11B:
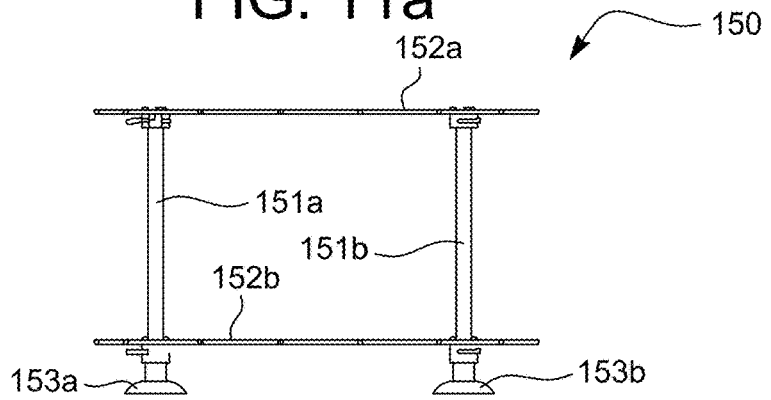

FIGS. 11*a-b* illustrate top and side views of a second embodiment of an article of manufacture providing a lower leg and ankle exercise device according to the present invention. The second embodiment of the frame structure 150 comprises a pair of U-shaped frame members 152*a-b* coupled to each end of 4 vertical support members 151*a-d*. A set of support feet 153*a-d* are coupled to a lower end of the 4 vertical support members 151*a-d* below the lower U-shaped frame member 152*b*. Similar to the first embodiment of the frame structure 110, the second embodiment of the frame structure 150 comprises a set of L-shaped connection slots 122*a-k* for attaching a stretchable cord as shown in FIGS. 13*a-d* to the shoe foot plate 120 of FIG. 15. The set of L-shaped connection hooks 122*a-k* are spaced about the U-shaped frame members 152*a-b* to provide connection hooks on all sides of the shoe plate 120.

Figure 12A:
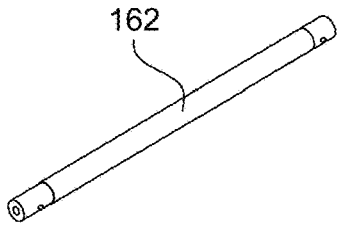
FIGS. 12*a-c* illustrate multiple views of a vertical support member of the second embodiment of an article of manufacture providing a lower leg and ankle exercise device according to the present invention.
Figure 12B:
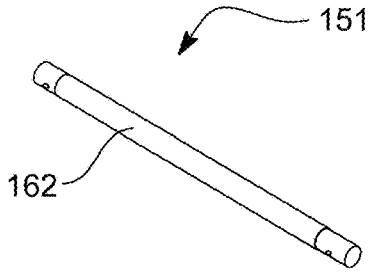
Figure 12C:
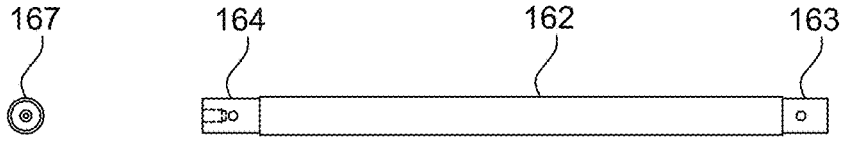
Figure 13A:
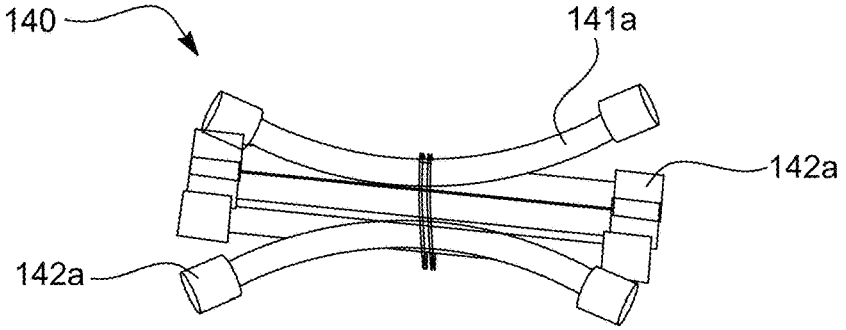
FIGS. 13*a-d* illustrate a plurality of different strength stretchable cords for connecting the shoe support member to the first and second embodiments of an article of manufacture providing a lower leg and ankle exercise device according to the present invention.
Figure 13B:
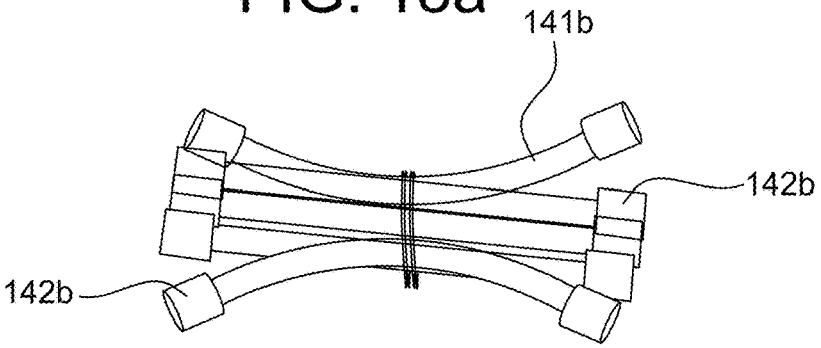
Figure 13C:
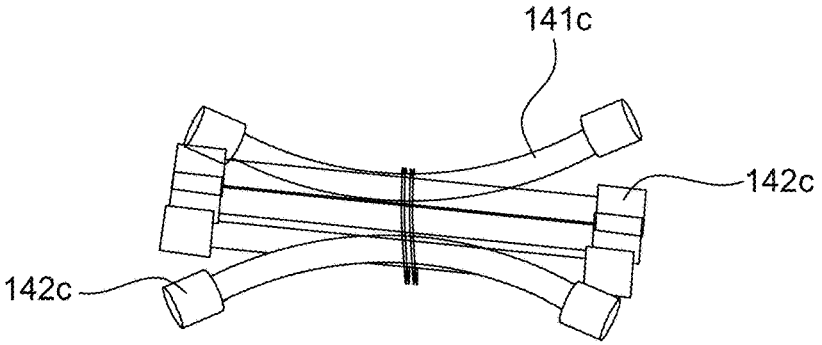
Figure 13D:
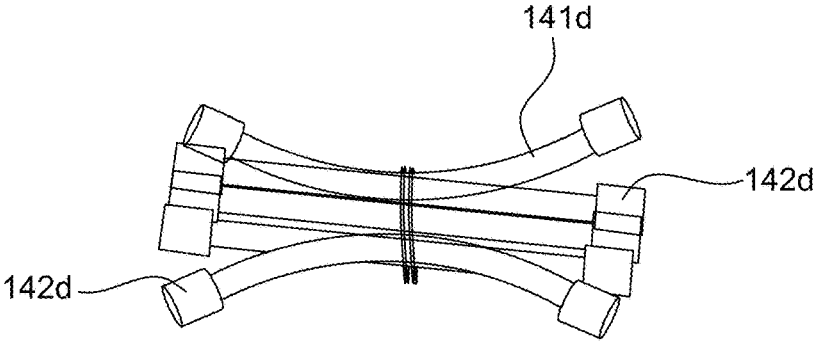
Figure 14A:
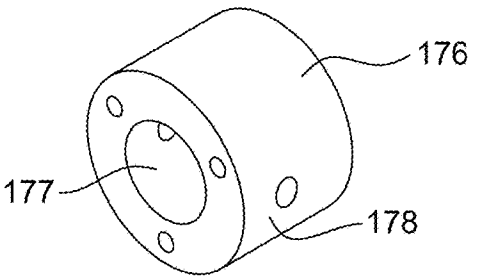
FIGS. 14*a-e* illustrate multiple views of an elastic band connection end of the first embodiment of an article of manufacture providing a lower leg and ankle exercise device according to the present invention.
Figure 14B:
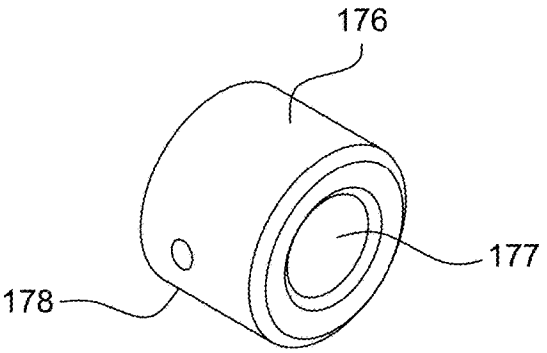
Figure 14D:
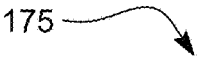
Figure 14D:
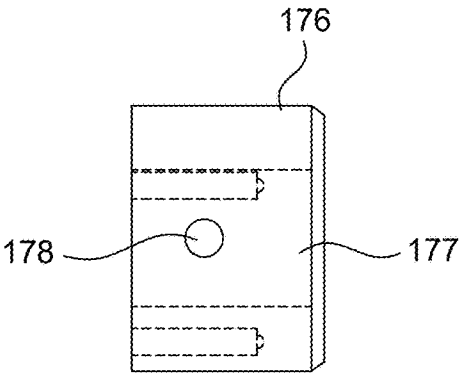
Figure 14C:
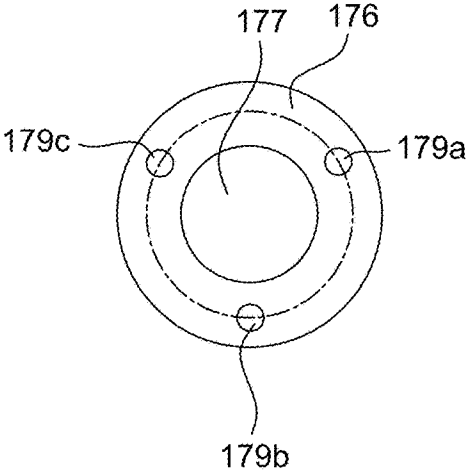
Figure 14E:
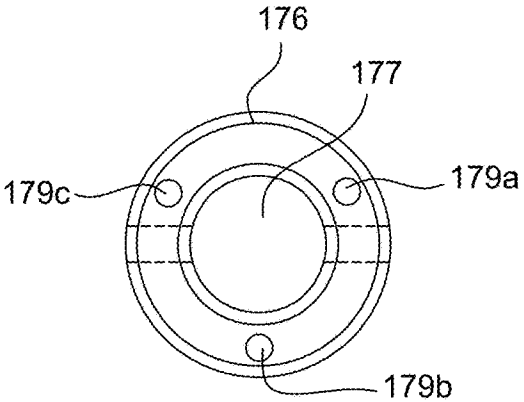

FIGS. 12*a-c* illustrate multiple views of a vertical support member of the second embodiment of an article of manufacture providing a lower leg and ankle exercise device according to the present invention. FIGS. 12*a-b* show a pair of opposing diagonal perspective views of one of the vertical support members 151. The vertical support member 151 is made of a solid support member 162 having a defined length corresponding to the height between the pair of horseshoe-shaped frame elements 152*a-b* of the frame structure 150. FIG. 12*c* shows an end view of the solid support member 162 having a threaded hole of accepting a screw (not shown) used to couple the vertical support member 151 to the horseshoe-shaped frame elements 152-*b*. FIG. 12*c* shows a side view of the solid support member 162. In this embodiment the solid support member 162 is shown to be a round rod in shape. One skilled in the art will recognize other shapes, including square, oval, and rectangular, may be used to define the solid support member 162.

FIGS. 13*a-d* illustrate a plurality of different strength stretchable cords for connecting the shoe support member to the first and second embodiments of an article of manufacture providing a lower leg and ankle exercise device according to the present invention. FIGS. 13*a-d* each show a set of elastic bands 140 for connecting the shoe support plate 120 of FIG. 15 to the frame structures 100, 150. Each of the sets of elastic bands 140 provides a different amount of resistance to a user when exercising by stepping upon the shoe support plate 120. The different sets of elastic bands 140 may be marked using different color band material or may have different markings to visually identify a resistance level provided by use of a particular set of elastic bands 140.

In a preferred embodiment, the elastic bands may be provided is different colors. These colors include yellow, red, green, blue, black, silver, and gold. An amount of resistance provided by each colored elastic band may be different to easily inform users of the strength of the elastic bands being used at any given time. One embodiment of elastic bands provides the resistance is pounds as recited in Table 1.

TABLE I

| Thera-Band Color Progression | | | | | | | |
|---|---|---|---|---|---|---|---|
| | Resistance in Pounds | | | | | | |
| % Elongation | Yellow | Red | Green | Blue | Black | Silver | Gold |
| 25% | 1.1 | 1.5 | 2.0 | 2.8 | 3.6 | 5.0 | 7.9 |
| 50% | 1.8 | 2.6 | 3.2 | 4.6 | 6.3 | 8.5 | 13.9 |
| 75% | 2.4 | 3.3 | 4.2 | 5.9 | 8.1 | 11.1 | 18.1 |
| 100% | 2.9 | 3.9 | 5.0 | 7.1 | 9.7 | 13.2 | 21.6 |
| 125% | 3.4 | 4.4 | 5.7 | 8.1 | 11.0 | 15.2 | 24.6 |
| 150% | 3.9 | 4.9 | 6.5 | 9.1 | 12.3 | 17.1 | 27.5 |
| 175% | 4.3 | 5.4 | 7.2 | 10.1 | 13.5 | 18.9 | 30.3 |
| 200% | 4.8 | 5.9 | 7.9 | 11.1 | 14.8 | 21.0 | 33.4 |
| 225% | 5.3 | 6.4 | 8.8 | 12.1 | 16.2 | 23.0 | 36.6 |
| 250% | 5.9 | 7.0 | 9.6 | 13.3 | 17.6 | 25.3 | 40.1 |

Each elastic band 140 comprises a length of elastic material 141*a-d* and a pair of elastic band connection ends 142*a-d* on each end of the length of elastic material 141*a-d*. The elastic band connection end 142*a-d* is sized to fit within the keyhole slots of the hexagon connection hook segments as described above. An inner edge of the elastic band connection ends 142*a-d* is larger than the straight slots in the hexagon connection hook segments permitting the elastic band connection ends 142*a-d* to engage the inner surface of the straight slots in the hexagon connection hook segments when coupling the shoe support plate 120 to the frame structure 110, 150. The elastic band connection ends 142*a-d* are inserted into the keyhole slot in the hexagon connection hook segments and slid inward towards the shoe support plate 120. When the inner surface of the straight slots in the hexagon connection hook segments engages the inner edge of the elastic band connection, the elastic band 140 is forced against the inner end of the straight slot in the hexagon connection hook segments as the elastic band is stretched to engage connection slots 122*a-l* in the shoe support plate 120. The forces generated by elastic bands 140 on opposite sides of the shoe support plate 120 coupled to opposing sides of the frame structure TOO, 150 creates a retention force that keeps the elastic bands 140 within the straight slots in the hexagon connection hook segments. This same retention force also keeps the elastic bands within the connection slots 122*a-l* of the shoe support plate 120. The connection slots 122*a-l* are wide enough to permit the stretchable cords of FIGS. 13*a-d* to pass long ways through the connection slots.

FIGS. 14*a-e* illustrate multiple views of an elastic band connection end of the first embodiment of an article of manufacture providing a lower leg and ankle exercise device according to the present invention. In a preferred embodiment, the elastic band connection end 175 comprise a cylindrical shaped element 176 having through hole 177 lengthwise through the element 176. The outer circumference of the cylindrical shaped element 176 is sided to be wider than the set of connection hooks 122*a-l* in the shoe plate 120 and the set of connection hooks in the support frames 110, 150. The stretchable cords 141*a-d* are coupled to an inner surface of the through hole 177 as the stretchable cords 141*a-d* are arranged to run out of and away from the cylindrical shaped element 176. A cylindrical shaped element 176 is coupled to each end of the stretchable cords 141*a-d* to permit the stretchable cords 141*a-d* to be coupled between the shoe plate 120 and the frame structure 110, 150.

The stretchable cords 141*a-d* are secured within the through hole 177 in each of the cylindrical shaped element 176 by a pin (not shown) inserted into a hole 178 through the side of the cylindrical shaped element 176 and connecting to the stretchable cords 141*a-d*. The cylindrical shaped element 176 also includes a set of mounting holes 179*a-c* to connect a pair of bushings to the top 152*a* and bottom 152*b* of the cylindrical shaped element 176.

Figure 15:
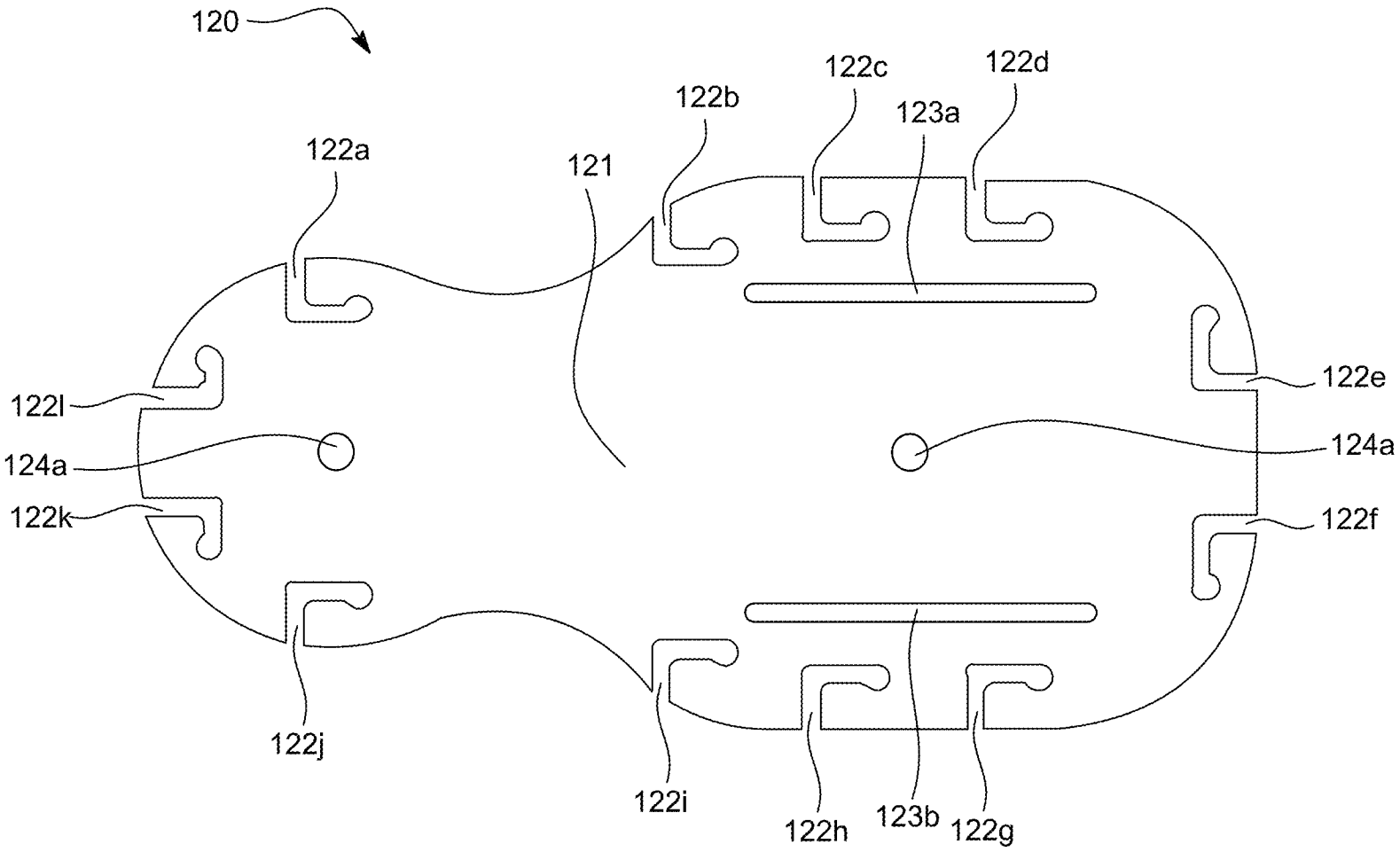
FIG. 15 illustrates a top view of a shoe support member of the first and second embodiments of an article of manufacture providing a lower leg and ankle exercise device according to the present invention.

FIG. 15 illustrates a top view of a shoe support member of the first and second embodiments of an article of manufacture providing a lower leg and ankle exercise device according to the present invention. The shoe support member 120 comprises a flat plate member 121 configured to correspond to a user's shoe when using the frame structures 110, 150 to perform rehabilitation and exercise functions with the present invention. A thinner end of the shoe plate 120 is made for a heel of the user and the longer fatter section of the shoe plate 120 is made for the toe of the user, with apertures 124*a* centrally located at both the thinner end and longer fatter section. A leather strap (not shown) may assist a user to secure a shoe or foot to the shoe plate 120 by placing the leather strap 125, as shown in FIGS. 16*a-c*, through the slots 123*a* and *b* in the shoe plate 120 and around the user's shoe (not shown).

Figure 16A:
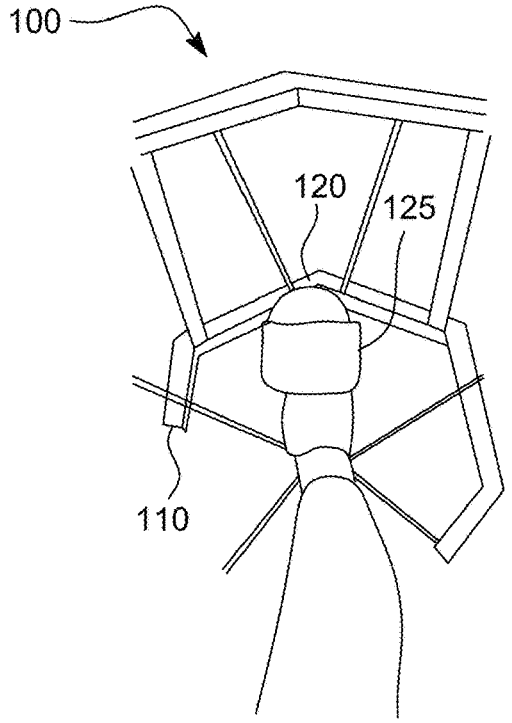
FIGS. 16*a-c* illustrate multiple views of first and second embodiments of an article of manufacture in use providing a lower leg and ankle exercise device according to the present invention.
Figure 16B:
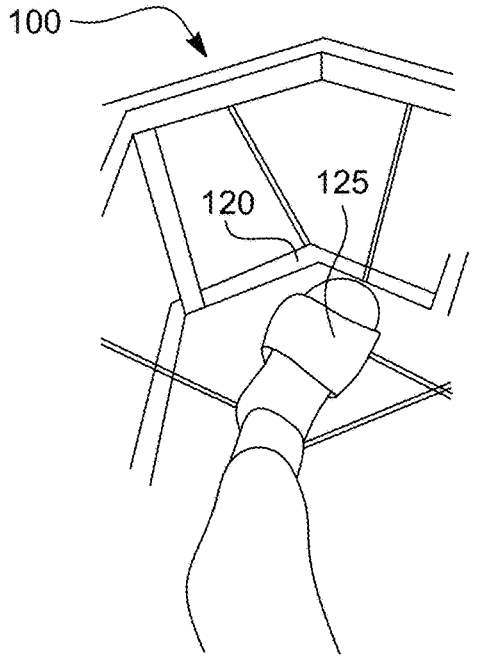
Figure 16C:
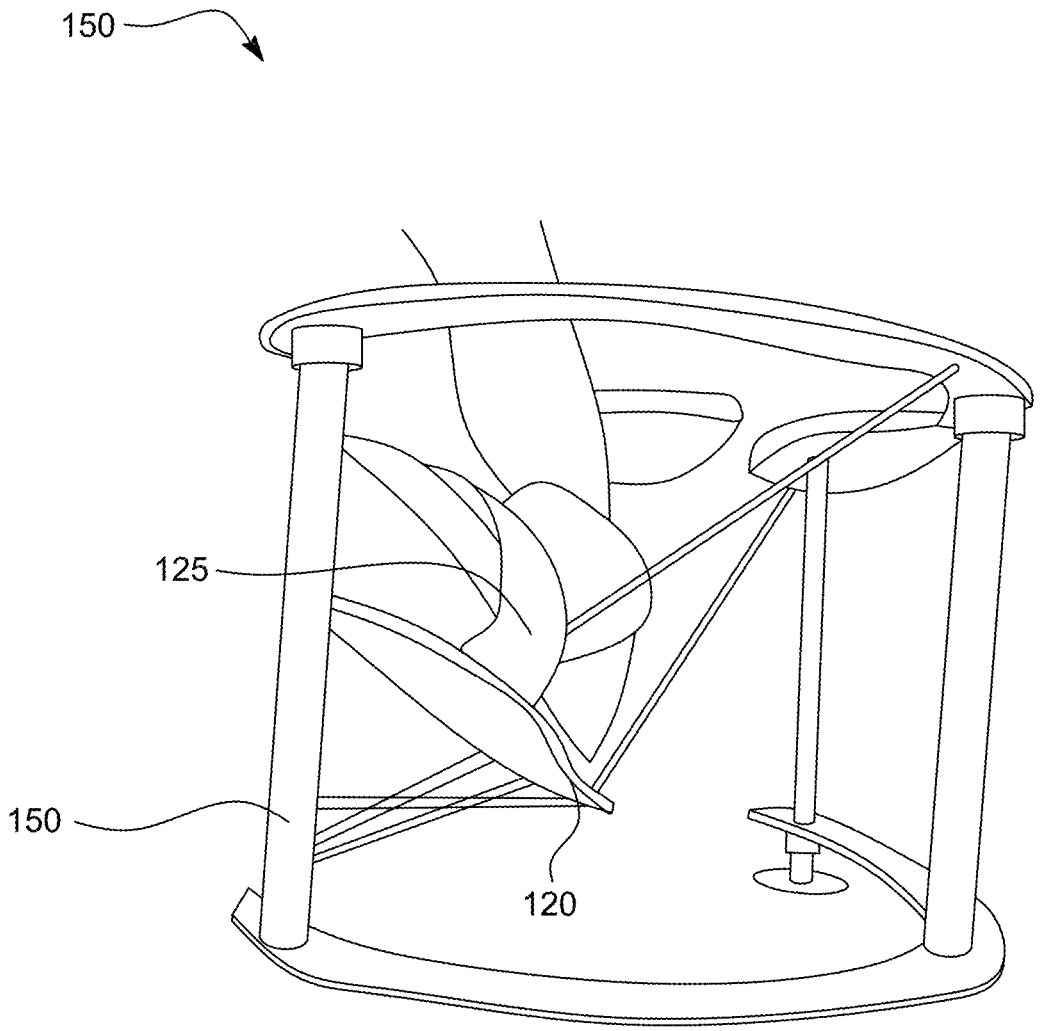

FIGS. 16*a-c* illustrate multiple views of first and second embodiments of an article of manufacture in use providing a lower leg and ankle exercise device according to the present invention. FIGS. 16*a-b* show the lower leg and ankle exercise device of the first embodiment in which the shoe plate 120 is coupled to the frame structure 110 by a plurality of stretchable cords 141*a-d*. The leather strap 125 is visible restraining the user's shoe to the shoe plate 120 allowing the user to move the foot and shoe in various directions pushing and pulling against the resistance forces provided by the stretchable cords 141*a-d* coupling the shoe plate 120 to the frame structure 110. The user may move the shoe plate in any direction including up and down as well as twisting from side to side. By moving the shoe plate 120 against the resistance of the stretchable cords 141*a-d*, the user may exercise the lower leg and ankle as needed.

FIG. 16*c* shows a side view of the lower leg and ankle exercise device 100 in use. The shoe plate 120 is visible under the user's shoe and held in place by the leather strap 125. A plurality of stretchable cords 141*a-d* are positioned about the lower leg and ankle exercise device 100 to connect the shoe plate 120 to the second embodiment of the frame structure 150. As described above, the user may exercise the lower leg and ankle by moving the shoe plate 120 against the resistance of the stretchable cords 141*a-d* in various directions.

Figure 17A:
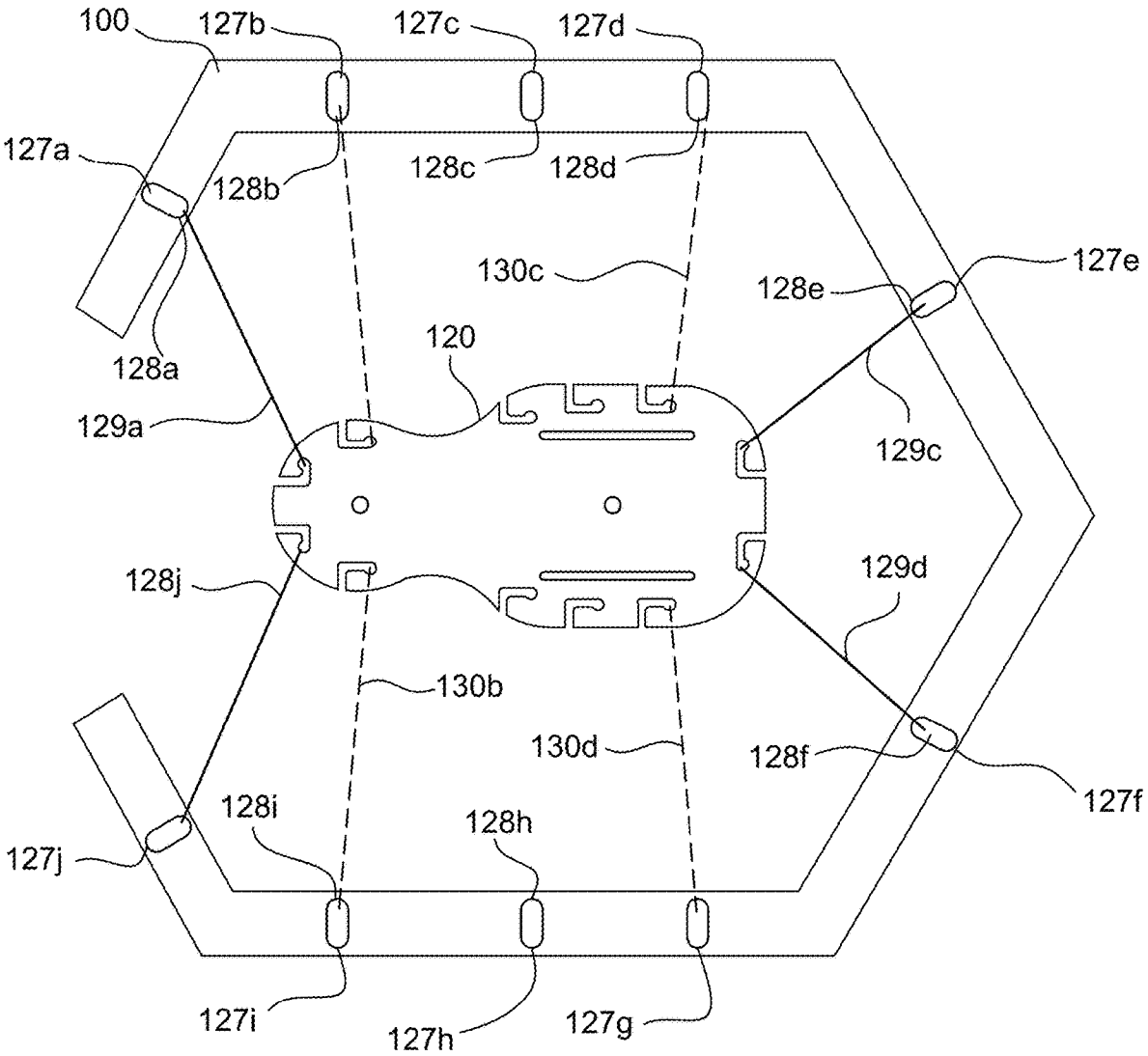
FIGS. 17*a-b* illustrate multiple views of stretchable cord arrangements with the first embodiment of an article of manufacture in use providing a lower leg and ankle exercise device according to the present invention.
Figure 17B:
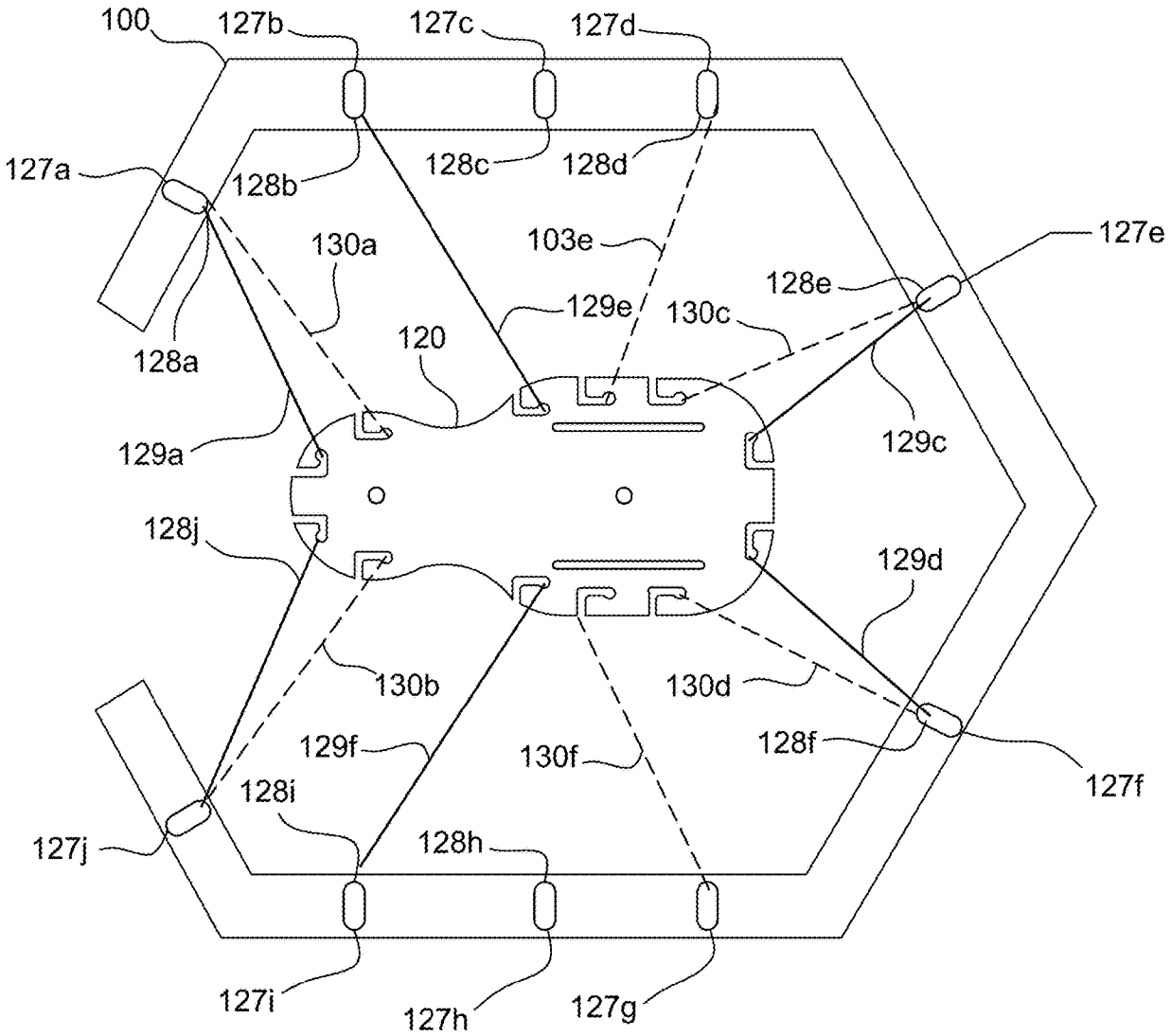

FIGS. 17*a-b* illustrate multiple views of stretchable cord arrangements with the first embodiment of an article of manufacture in use providing a lower leg and ankle exercise device according to the present invention. FIGS. 17*a-b* show different arrangements of the stretchable cords 129*a-d* that are connecting the connection slots 122*a-l* in the shoe plate 120 to the connection slots 127*a-j* in the top frame members 101*a-b*-105*a-b* and a separate arrangements of the stretchable cords 130*a-d* that are connecting the connection slots 122*a-l* in the shoe plate 120 to the connection slots 128*a-j* in the bottom frame members 101*c-d*-105*c-d*. FIG. 17*a* shows 4 stretchable cords 129*a-d* connecting the shoe plate 120 to the frame structure 110 and 4 stretchable cords 130*a-d* connecting the shoe plate 120 to the frame structure 110. Similarly, FIG. 17*b* shows 6 stretchable cords 129*a-f* connecting the shoe plate 120 to the frame structure 110 and 6 stretchable cords 130*a-f* connecting the shoe plate 120 to the frame structure 110. These various stretchable cords may be arranged in any number of configurations as shown in FIG. 17*a-b* to exercise various parts of a lower leg and ankle.

Even though particular combinations of features are recited in the present application, these combinations are not intended to limit the disclosure of the invention. In fact, many of these features may be combined in ways not specifically recited in this application. In other words, any of the features mentioned in this application may be included in this new invention in any combination or combinations to allow the functionality required for the desired operations.

No element, act, or instruction used in the present application should be construed as critical or essential to the invention unless explicitly described as such. Further, the phrase "based on" is intended to mean "based, at least in part, on" unless explicitly stated otherwise.

What is claimed is:

1. A lower leg and Achilles tendon exercise device, comprising:

a top frame structure having a first plurality of connection hooks about a perimeter;

a bottom frame structure oriented parallel to the top frame structure having a second plurality of connection hooks about a perimeter;

a plurality of vertical support members coupled between the top frame structure and the bottom frame structure;

a shoe support member having a plurality of connection hooks positioned about an outer edge of the shoe support member; and a plurality of stretchable cords configured to couple the shoe support member to the top frame structure and the bottom frame structure, the plurality of stretchable cords being received in either the first plurality of connection hooks of the top frame structure or the second plurality of connection hooks of the bottom frame structure, and the plurality of connection hooks of the shoe support member so as to locate the shoe support member in a suspended position above the bottom frame structure and below the top frame structure.

2. The exercise device according to claim 1, wherein the connection hooks of the first and second plurality of connection hooks each comprise a keyhole end terminating at an inner end configured to retain an end of a stretchable cord of the plurality of stretchable cords.

3. The exercise device according to claim 2, wherein each stretchable cord of the plurality of stretchable cords comprises a stretchable band having opposing ends and an elastic band connection end coupled to each opposing end, the elastic band connection end being configured to engage a surface of the top or bottom frame structures with a first opposing end and to engage a surface of the shoe support member with a second opposing end when the stretchable band is disposed within a connection hook of the plurality of connection hooks of the shoe support member and a corresponding connection hook of first and second plurality of connection hooks of the top frame structure or bottom frame structure.

4. The exercise device according to claim 3, wherein each of the stretchable bands have a resistance corresponding to a color marking of the stretchable bands between 1.1 lbs. and 7.9 lbs. when stretched to an elongation of 25% of its length.

5. The exercise device according to claim 4, wherein each of the stretchable bands have a resistance corresponding to a color marking of the stretchable bands between 2.9 lbs. and 21.6 lbs. when stretched to an elongation of 100% of its length.

6. The exercise device according to claim 5, wherein each of the stretchable bands have a resistance corresponding to a color marking of the stretchable bands between 5.9 lbs. and 40.1 lbs. when stretched to an elongation of 250% of its length.

7. The exercise device according to claim 4, wherein the colored markings comprise one or more of the following: a yellow, a red, a green, a blue, a black, a silver, and a gold marking.

8. The exercise device according to claim 2, wherein the top frame structure and the bottom frame structure comprise an identical set of straight members arranged in a hexagon shape, the hexagon shape having an open end and a closed end.

9. The exercise device according to claim 8, wherein each of the straight members have at least one connection hook.

10. The exercise device according to claim 9, wherein each of the straight support members has a rectangular shape with a hollow center.

11. The exercise device according to claim 8, wherein the set of straight members are welded together.

12. The exercise device according to claim 2, wherein the top frame structure and the bottom frame structure each comprise a U-shaped frame member, the first and second plurality of connection hooks being located about an outer edge of the perimeter of the U-shaped frame members.

13. The exercise device according to claim 12, wherein the first and second plurality of connection hooks on opposing sides of the U-shaped frame members are located in identical positions from an open end.

14. The exercise device according to claim 2, wherein the shoe support member comprises connection hooks of the plurality of connection hooks positioned on opposing sides of the shoe support member.

15. The exercise device according to claim 2, wherein the top frame structure and the bottom frame structure are made of steel.

* * * * *